US007373716B2

(12) United States Patent
Ras et al.

(10) Patent No.: US 7,373,716 B2
(45) Date of Patent: May 20, 2008

(54) METHOD FOR CONSTRUCTING PERMANENT MAGNET ASSEMBLIES

(75) Inventors: Christopher A. Ras, Arlington Heights, IL (US); Gareth Hatch, East Dundee, IL (US); Mike Schilling, Geneva, IL (US)

(73) Assignee: Dexter Magnetic Technologies, Inc., Fremont, CA (US)

( * ) Notice: Subject to any disclaimer, the term of this patent is extended or adjusted under 35 U.S.C. 154(b) by 357 days.

(21) Appl. No.: 10/691,679

(22) Filed: Oct. 22, 2003

(65) Prior Publication Data

US 2005/0086793 A1 Apr. 28, 2005

(51) Int. Cl.
*H01F 7/02* (2006.01)
*H01F 1/00* (2006.01)

(52) U.S. Cl. ..... 29/607; 29/608; 29/609; 29/602.1; 29/467; 428/900; 428/928

(58) Field of Classification Search ..... 29/607, 29/608, 609, 602.1, 603.2, 830, 467, 468; 336/218, 234; 428/900, 928; 277/629
See application file for complete search history.

(56) References Cited

U.S. PATENT DOCUMENTS

| | | | | |
|---|---|---|---|---|
| 2,855,639 | A * | 10/1958 | Korb | 277/629 X |
| 4,470,131 | A * | 9/1984 | Hatayama et al. | 29/607 X |
| 4,638,281 | A * | 1/1987 | Baermann | 29/607 X |
| 5,046,235 | A * | 9/1991 | Taneda et al. | 29/609 X |
| 6,336,989 | B1 * | 1/2002 | Aoki et al. | 29/467 X |

FOREIGN PATENT DOCUMENTS

| | | | | |
|---|---|---|---|---|
| JP | 5-205932 | * | 8/1993 | 29/609 |

* cited by examiner

*Primary Examiner*—A. Dexter Tugbang
(74) *Attorney, Agent, or Firm*—Blakely Sokoloff Taylor & Zafman

(57) ABSTRACT

A method for constructing a permanent magnet assembly by using a non-magnetic frame between individual magnet segments to restrain the movement of the magnet segments. The frame restricts the movement of the magnets during assembly. The frame also provides an effective system for replacing magnets in the existing assembly.

4 Claims, 7 Drawing Sheets

METHOD FOR CONSTRUCTING PERMANENT MAGNET ASSEMBLIES

BACKGROUND OF THE INVENTION

1. Field of the Invention

The invention relates generally to magnet assemblies and in particular to a method for constructing a permanent magnet assembly by using a frame to restrain the movement of magnets.

2. Description of the Related Art

Numerous methods exist for construction of magnetic assemblies. The desired configuration and size of the magnetic assembly often dictates the method required for construction of the assembly, due, at least in part, to the large forces inherent in magnetic materials.

Permanent magnet materials function like any other material until magnetized by an external source. Manufacturing operations on permanent magnet materials such as grinding, slicing, etc. are well established, and pose no significant challenges to those equipped with the proper tools. Although charged magnetic materials can be machined, unmagnetized stock is preferred.

Magnetic materials are frequently altered by machining operations to shape the materials and to adjust the magnetic field characteristics of the materials. The altered, unmagnetized, magnetic materials may be assembled and then magnetized to full saturation, to minimize the exposure of assembly personnel to potentially dangerous forces that would otherwise exist if assembling magnetized materials. Although it is preferred that all magnets be charged after assembly, the sheer size and, more importantly, orientation of magnetic materials in some assemblies require personnel to work with fully magnetized materials. The associated dangers are significant and compounded as the size of the magnetized materials increases.

Magnetic assemblies may involve permanent magnets positioned in a manner that counters the natural alignment tendencies of the magnets, creating very large torques and forces that may lead to self-destruction if not properly restrained, during the assembly process.

Adhesives are currently the main fastening mechanism in the majority of magnetic assemblies. During the assembly process, external restraints are placed on the magnet being loaded into the assembly. These restraints are typically 3-axis ball screw driven linear slides. Adhesive is placed on the contact surfaces of the target magnet, which is then placed into its location in the assembly and held there until the adhesive has set.

Magnets being installed in magnet assemblies often experience three orthogonal forces. These forces generally differ in magnitude making it difficult to maintain the magnet's physical orientation as it is being assembled. Increased magnet sizes or certain assemblies can create forces that can approach hundreds or thousands of pounds and make hand assembly difficult, dangerous, or even impossible. As stated above a mechanical means of assembling such structures is required. Such means can become prohibitively large and costly. Furthermore, once the adhesive is set and the mechanical restraints removed, the loads imparted on the target magnet are fully absorbed by the adhesive. Although this has proven to be an acceptable method of assembly, broken or faulty bond lines may exist causing magnets to come loose.

Once a magnet assembly is completed, an exoskeleton of metal is often placed around the unit to act as the last line of defense against any failed bond line.

Nonetheless, at times during the assembly process the adhesive is the only fastening mechanism used to constrain the vast amounts of energy stored in the unit.

Magnets may be improperly oriented or defectively attached during construction of the assembly. Repair of magnets assembled in incorrect orientations can be difficult as well as dangerous. Attempting to separate faulty magnets may also sacrifice the integrity of any other bond lines or damage any other magnets in the system.

BRIEF SUMMARY OF THE INVENTION

A method for constructing permanent magnet assemblies utilizes a frame that houses and restricts movement of magnets being added to the assembly. The frame may be between any or all adjacent magnets or magnet blocks in an assembly. The frame is particularly useful in assemblies where the magnetic orientations differ between adjacent magnets. In another aspect, the frame may form an interlocking mesh to aid in constructing permanent magnet assemblies.

In another aspect the frame may contain deformations that structurally hold the magnets in place.

BRIEF DESCRIPTION OF THE SEVERAL VIEWS OF THE DRAWINGS

The embodiments of the invention are illustrated by way of example and not limitation in the accompanying figures, in which.

DETAILED DESCRIPTION OF THE INVENTION

Figure 1:
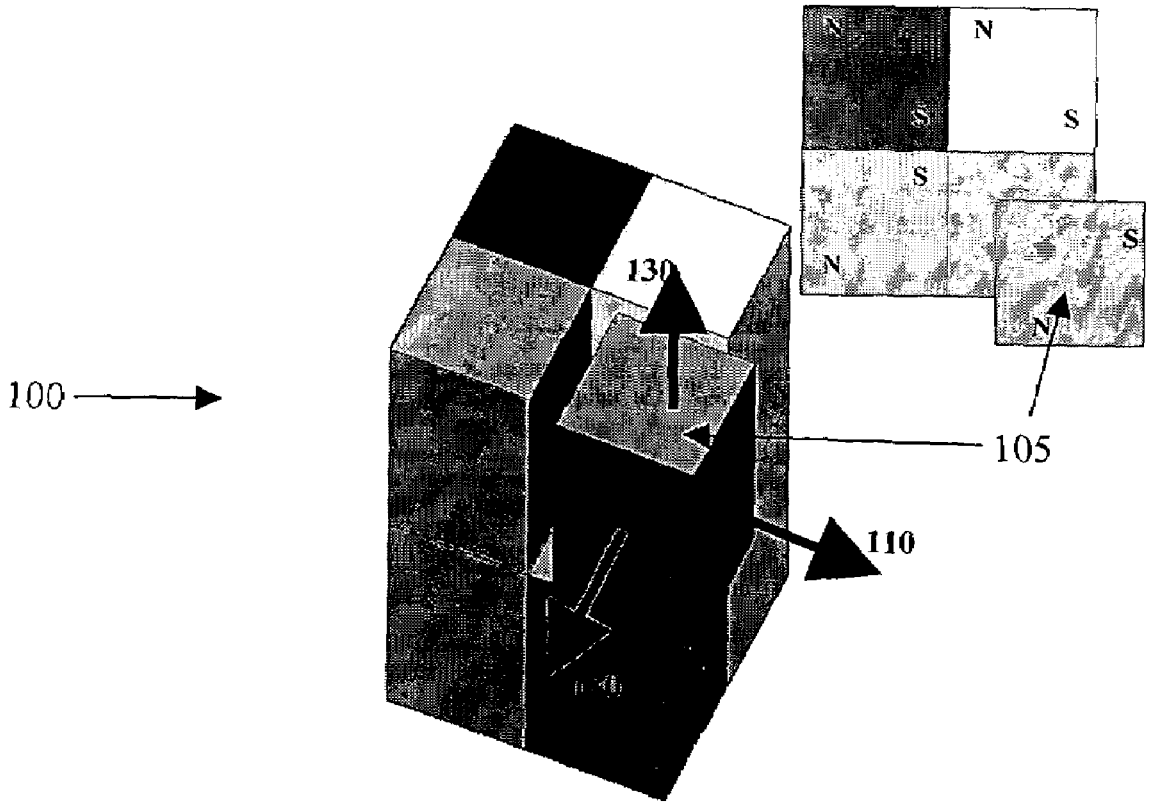
FIG. 1 (PRIOR ART)
FIG. 1 provides a three dimensional view depicting three orthogonal forces acting on a magnet being added to a permanent magnet assembly.

FIG. 1 illustrates potentially three orthogonal forces acting on an example magnet 105 being placed near a magnet assembly 100 and depicts a typical situation encountered during construction of the magnet assembly. The three orthogonal forces 110, 120 and 130 are a representation of the forces that may act on magnet 105 in a certain position relative to the magnet assembly 100. These forces change with respect to the magnet's orientation and/or the orientation of other magnets in the assembly. For example, any of the represented orthogonal forces may be zero. The magnet assembly may consist of magnets with magnetic polar orientations at right angles or any other non-aligned magnetic polar orientation thus increasing or decreasing the orthogonal forces acting on magnet 105.

An embodiment 200 of the invention is described with reference to FIG. 2. Two permanent magnet blocks, 220 and 240, are shown being inserted into a non-magnetic frame 210. The permanent magnet blocks 220 and 240 may each comprise one or more magnets. The magnets in any embodiment may be comprised of iron, nickel, cobalt, or rare earth materials such as neodymium and samarium, or combinations or derivatives thereof, such as neodymium iron boron. These and other high coercivity materials (with an intrinsic coercivity greater than the flux density provided by the magnetic structure) may be used. The frame 210 in any embodiment may consist of any non-magnetic material or even a marginally magnetizable ferromagnetic material.

Figure 2:
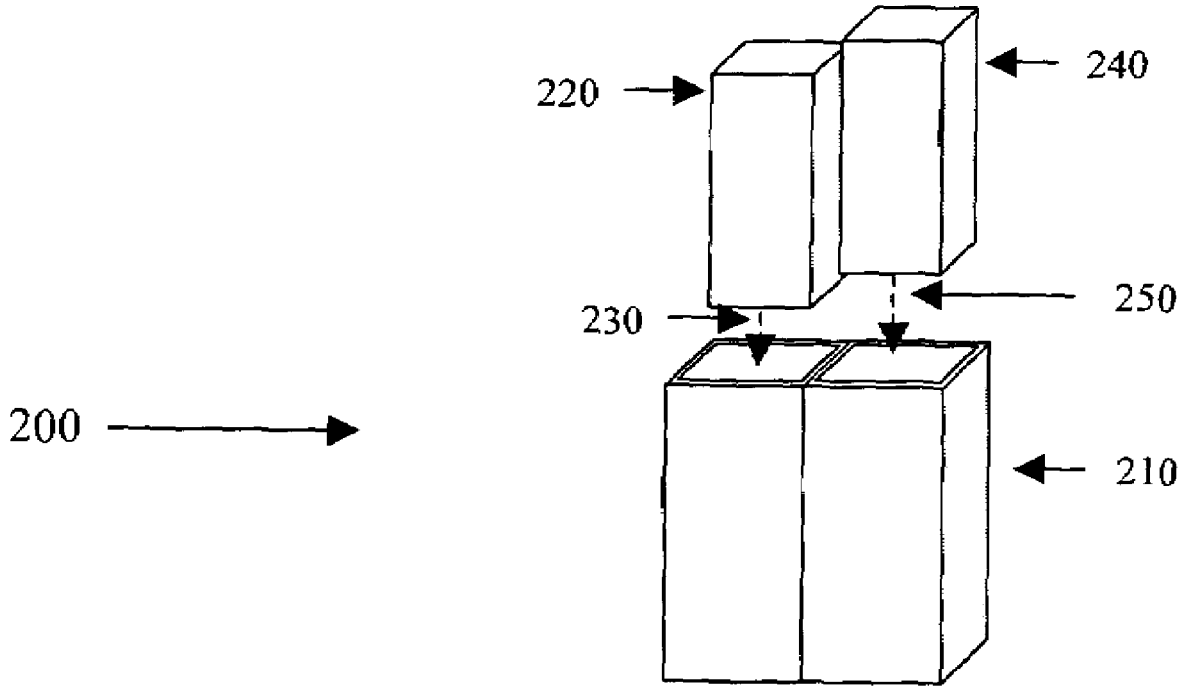
FIG. 2 provides a view of two magnets and a frame for receiving them in the assembly process to create a magnetic assembly, in one embodiment of the invention.

The magnets illustrated in FIG. 2 are square. However, other magnet shapes that achieve true tessellation are equally applicable to the invention. For example, triangle-, hexagonal- and octagonal-shaped magnets may be used.

In any embodiment of the invention, the magnets may differ in magnetic polar orientation. An embodiment consists of the frame 210 having a wall adjacent sufficient sides of the magnets such that the frame restricts movement of each magnet in at least one direction. Such a frame facilitates construction of a magnet assembly, and permanent magnet assemblies in particular, as described below.

The frame 210 in FIG. 2 has receiving slots for magnet blocks 220 and 240. Magnet block 220, for example, is first inserted at 230 into the receiving slot of the frame 210. In this example, the frame 210 prevents movement of magnet block 220 in the direction in which the magnet is being inserted or from which the magnet may be removed. In one embodiment frame 210 may allow more than one dimension of movement for magnet block 220 but may still restrict movement by the magnet block 220 in at least one direction.

In FIG. 2, the magnet block 240 may be inserted at 250 into frame 210, for example, once the first magnet block 220 has been inserted into the frame 210 or concurrently therewith, according to various manufacturing methods. The magnet blocks 220 and 240 may have different polar orientations, which may cause the magnets to misalign, absent a frame, thus making construction of magnetic assembly 200 difficult. The frame 210 restricts the movement for each magnet block 220 and 240 in at least one direction thus aiding the construction of magnetic assemblies. In one embodiment, the frame 210 restricts the movement of each magnet block 220 and 240 to one axis of direction.

In FIG. 2 the magnet blocks 220 and 240 may be attached to the frame 210 by mechanical or adhesive ways. Adhesive may be applied to the surfaces of the magnet blocks 220 and 240 to connect to frame 210, and the magnet blocks may be held in place mechanically until the adhesive sets, at which time the mechanical restraints may be removed. Alternatively, the frame could receive the adhesive or it may be applied to both the frame and the surfaces of the magnet blocks. Upon the adhesive setting, the mechanical restraints may be removed and the magnet blocks 220 and 240 remain in the frame due to the set adhesive.

In another embodiment, the frame may be configured to handle any number of magnet blocks in creating a magnet assembly, such as described below for FIG. 3 and FIG. 5.

An embodiment 300 of the invention is now described with reference to FIG. 3. A magnet assembly is illustrated having a magnet block 305 being added to the assembly, magnet blocks 325 and 335, already added to the assembly, a frame 340 into which the magnets are inserted, and including an outer portion of the frame 345 that acts as an exoskeleton to bind the magnet blocks together. The figure illustrates the potential forces 310, 320 and 330 acting on the magnet 305 being added to the assembly 300, depending on the magnetic polar orientation of other magnets in the assembly. FIG. 3 provides a sectional view 350 to illustrate a magnet block 325. In practice, the exoskeleton 345 encloses the assembly. The embodiment 300 in FIG. 3 has receiving slots for all magnet blocks, including magnet blocks 305 and 325. FIG. 3 shows magnet block 305 being inserted into the receiving slot of the frame 340, over top of the already inserted magnet block 325. The frame 340 prevents movement of magnet block 305 in any but one direction. In one embodiment frame 340 may allow more than one dimension of movement of a magnet block including magnet block 305.

Figure 3:
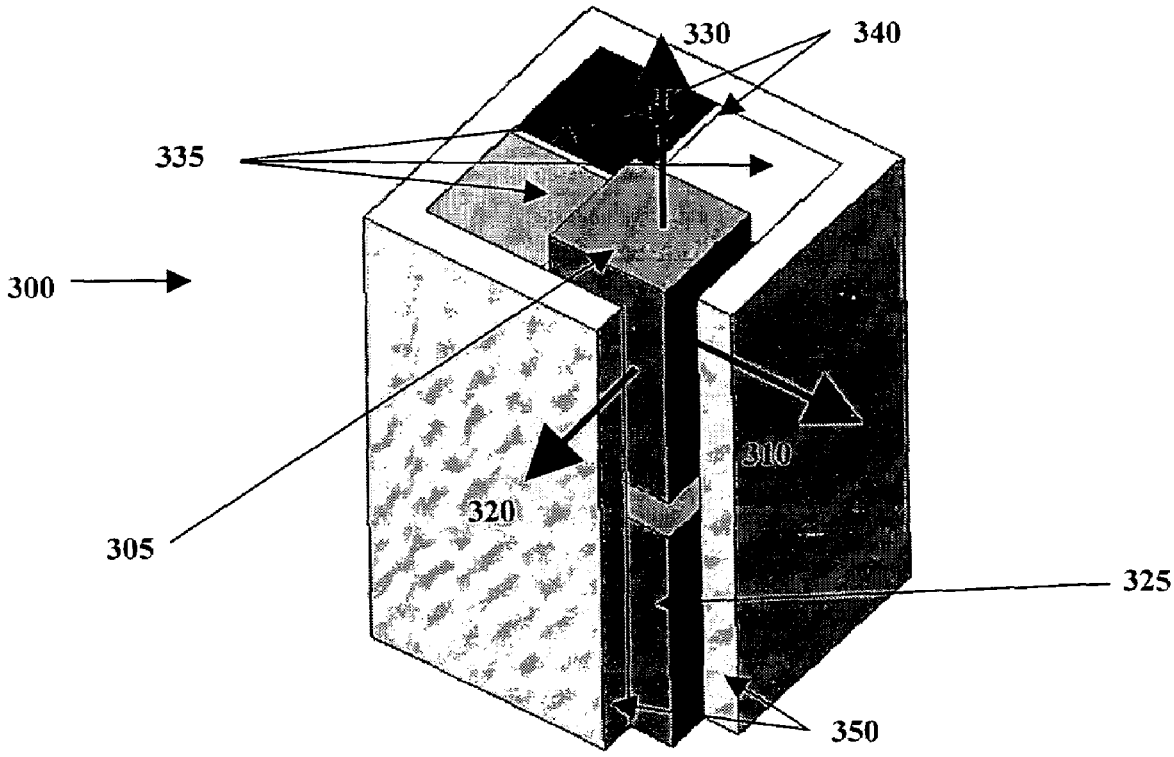
FIG. 3 provides a view of a magnet assembly consisting of a frame and more than two magnets, in one embodiment of the invention.

In FIG. 3 the magnet blocks may be attached to the frame 340 by mechanical or adhesive ways. Adhesive may be applied to the surfaces of the magnet blocks to connect the magnet blocks to frame 340. The magnet blocks may be held in place mechanically until the adhesive sets, at which time the mechanical restraints may be removed. Upon the adhesive setting, the mechanical restraints may be removed but the magnet blocks remain assembled in the frame due to the set adhesive.

Figure 7:
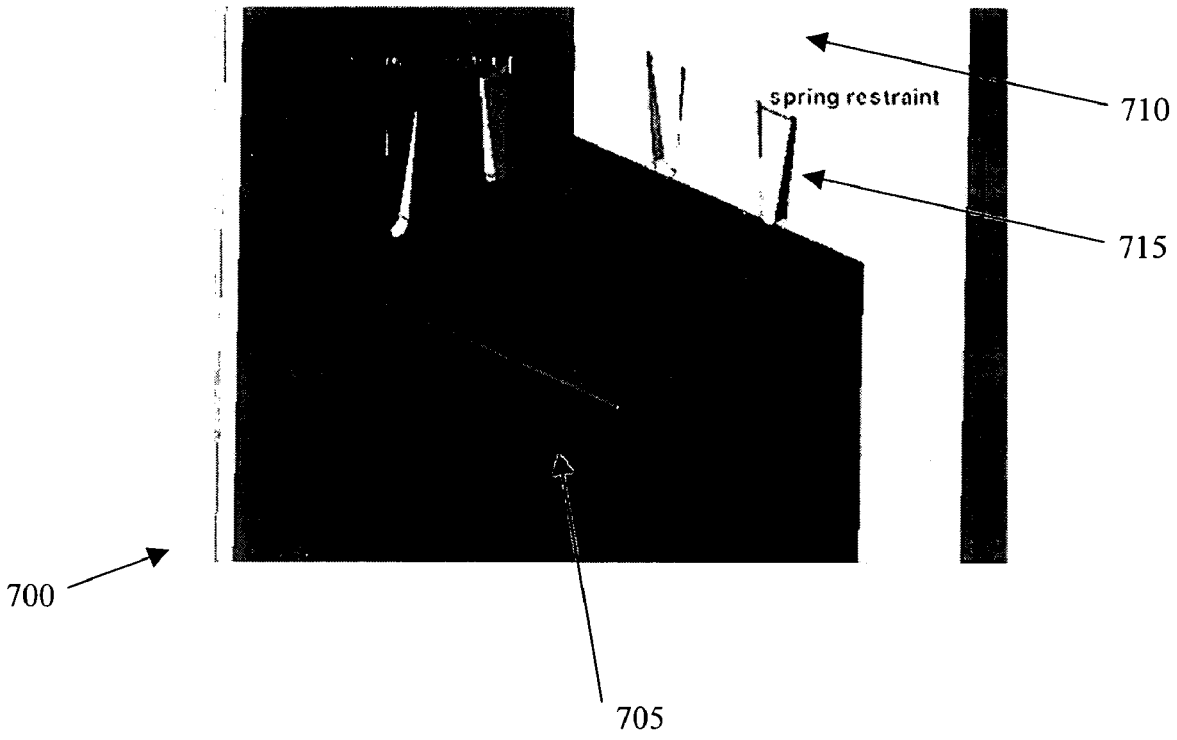
FIG. 7 provides a view of a deformation in the frame acting as a restraint to a magnet inserted into the frame.

The frame 340 may have a deformation, such as the spring restraint depicted in embodiment 700 in FIG. 7 and described below, which locks the magnet blocks into place once placed in the frame 340. The deformation may be an indention or simply a semi cut portion of the frame 340 operating as a spring such that once the magnet block has been pressed past it, the magnet force acting on the block cannot overcome the locking mechanism. It would be understood by one of skill in the art that many types of mechanical restraint either as a deformation in the frame material or attached to the frame material may be used by itself or in combination with the adhesive to keep the magnet blocks in the frame 340 and thus maintain the magnet assembly 300.

Figure 4:
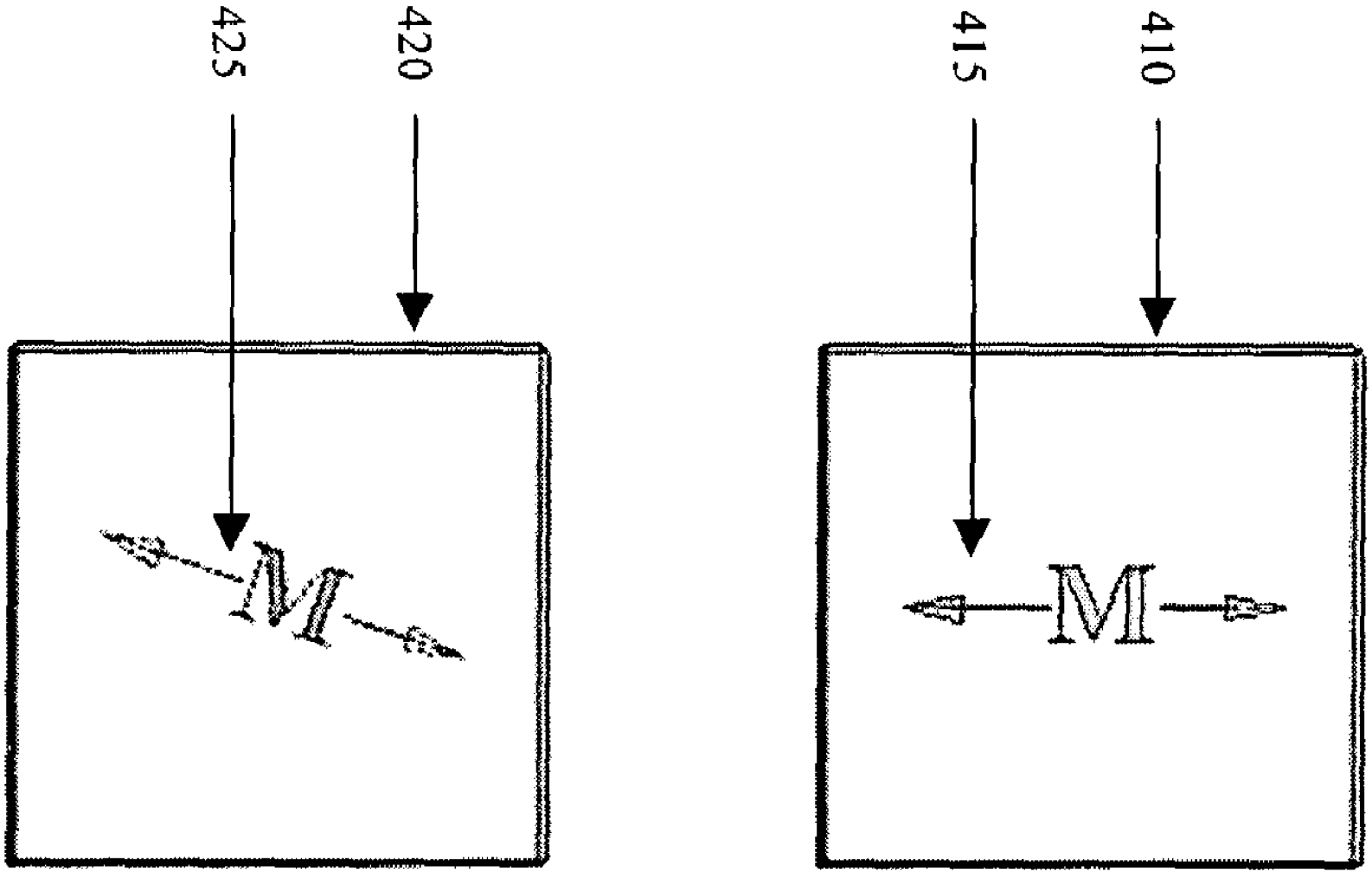
FIG. 4 depicts two different magnetic polar orientations.

FIG. 4 depicts magnet blocks 410 and 420 with different magnetic orientations. Magnet 410 has an orientation 415 that is perpendicular to the face of magnet 410, whereas magnet 420 has an orientation 425 that is aligned at an acute angle to the face of magnet 420. In FIG. 4 the acute angle is 30 degrees, therefore, the orientations of magnets 410 and 420 differ by 30 degrees. The 30 degree difference in magnetic orientations is particularly efficient for generally square magnet blocks since 12 orientations can occur based upon only the two magnet blocks 410 and 420, as depicted in FIG. 5. However, it is appreciated that other angles of magnetic orientation with respect to a face of a magnet is also possible without departing from the spirit of the invention. The different orientations allow magnet blocks to be inserted into a frame in a manner that facilitates creating a magnetic circuit among the assembled magnetic blocks. In other words magnet blocks can be placed in a closed loop manner consisting of placing the north polar end of one magnet block adjacent the south polar end of another magnet block, and furthermore by having an offset angle between magnetic field orientations for at least some of the adjacent magnet blocks, as depicted in FIG. 5.

Magnet blocks may consist of smaller or even larger offset angles than the 30 degrees shown in FIG. 4. Referring to FIG. 5, as the angle offsetting magnetic field orientations for adjacent magnet blocks is decreased the resulting magnetic field strength of a magnet assembly increases. It would be understood by one of skill in the art to vary the offset angle of magnetic field orientations to other than 30 degrees as depicted in FIG. 4.

Figure 5:
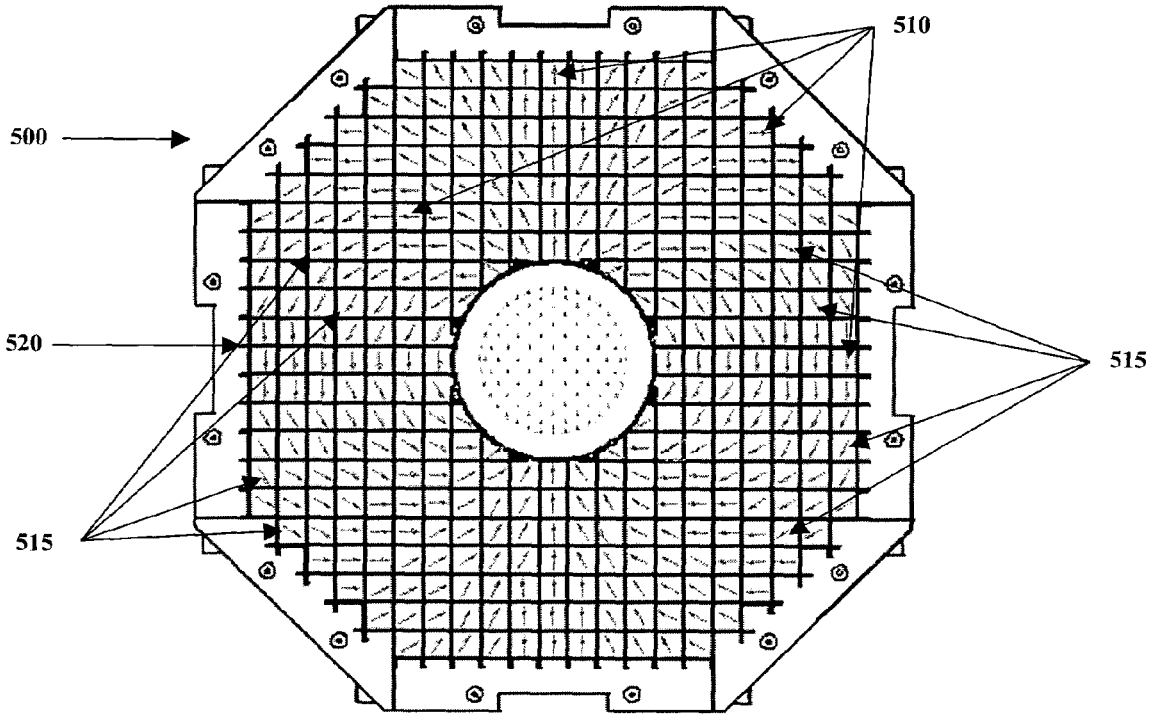
FIG. 5 depicts a magnet assembly consisting of a frame, and magnets oriented in polar directions in a manner to complete a magnetic circuit.

An embodiment 500 of the invention is described with reference to FIG. 5, depicting a top view of a magnetic assembly comprising magnet blocks 510 and 515 inserted into a frame 520, with the magnet blocks 510 and 515 oriented such that they complete a magnetic circuit. Each arrow depicted in the 12 different orientations of magnet blocks 510 and 515 represents the magnetic polar orientation of that particular magnet block once it is inserted into the assembly. As stated above, by utilizing only the magnet blocks 410 and 420 as depicted in FIG. 4, the embodiment 500 may be constructed with magnets having 12 different magnetic polar orientations. The embodiment 500 utilizes the different magnetic polar orientations to complete a magnetic circuit and therefore increases the magnetic field strength of the magnet assembly. Other embodiments such as 500 may be constructed utilizing magnetic polar orientations differing by other than 30 degrees.

Figure 6:
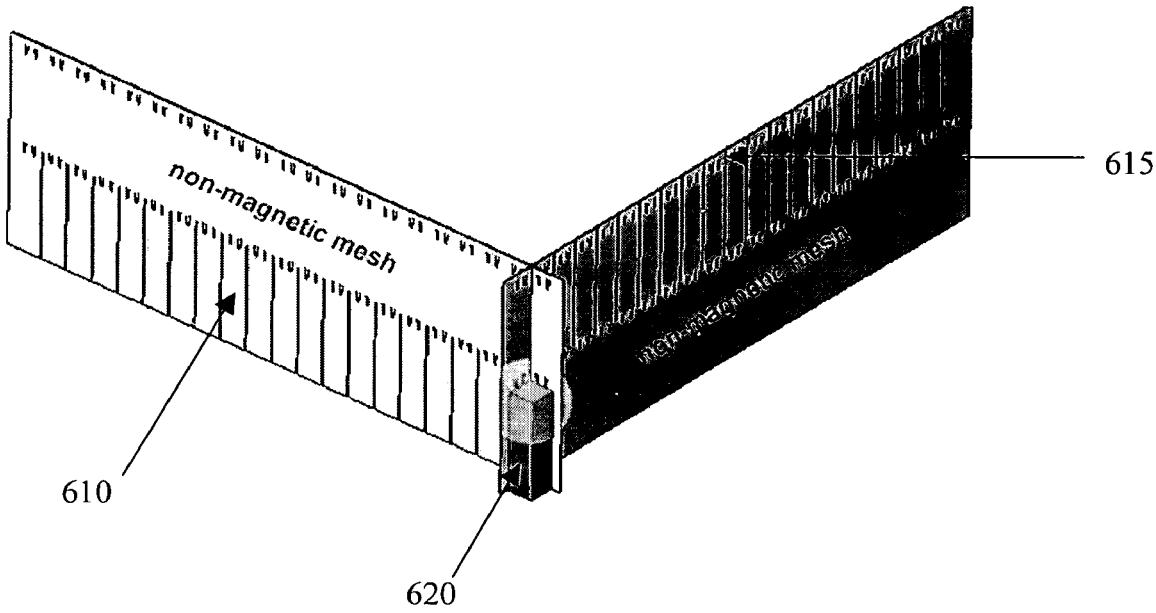
FIG. 6 provides a cut-away view of the frame in a magnet assembly, showing an interlocking mesh embodiment for the frame.

FIG. 6 illustrates a cut-away view of the frame and a magnet block 620 in the assembly in FIG. 5. In one embodiment the frame consists of a first portion 610 that interlocks with a second portion 615 much in the nature that cardboard separators in cardboard boxes interlock. In one embodiment the portions 610 and 615 are comprised of a non-magnetic material. It would be understood by one of skill in the art for the frame portions to alternately be slightly magnetic such as any ferromagnetic material.

The cut-away view depicted in FIG. 6 is accomplished by adjoining the first portion 610 with the second portion 615 such that they form a frame. The frame generally wraps around the magnet, but the cut-away view in FIG. 6 represents the magnet block being surrounded by the frame on only 2 sides. FIG. 6 further depicts a spring restraint locking mechanism further defined below in embodiment 700. The interlocking mesh allows for simplified construction of the frame that can be utilized in construction of a magnet assembly, as described above. FIG. 6 illustrates that magnet block 620 can be restrained in the frame below the spring restraint locking mechanism. Furthermore, the locking mechanism allows an additional magnet block to be placed on top of magnet block 620.

An embodiment 700 of the invention is described with reference to FIG. 7. The embodiment 700 shows a magnet block 705, a frame 710 and a spring restraint 715 in the frame 710. The spring restraint 715 is a structure on the frame that acts to keep the magnet block 705 in place once it has been situated. The spring restraint may likewise be any deformation in the frame 710 material or may actually be an addition to the frame so long as the structure allows the magnet block 705 to be placed into the receiving portion of the frame in a manner that physically restricts extraction of the magnet block 705 from the frame 710. In FIG. 7 the magnet block 705 is inserted into the frame 710. Upon insertion of the magnet block 705 into the frame 710, the spring restraint 715, or other similar locking structure or deformation of the frame material 710, physically restrains extraction of the magnet block 705 from the frame 710.

The embodiment 700 may be utilized in frame 340 to lock the magnet blocks 305, 325 or 335 into place once placed in the frame 340. The deformation may be an indention or simply a semi cut portion of the frame 340 operating as a spring such that once the magnet block has been pressed past it, the magnet force acting on the block cannot overcome the locking mechanism. It would be understood by one of skill in the art that many types of mechanical restraint either as a deformation in the frame material or attached to the frame material may be used by itself or in combination with the adhesive to keep the magnet blocks 305 and 325 in the frame 340 and thus maintain the magnet assembly 300. The embodiment 700 may work with any other frame dimension, such as depicted in FIG. 2 or FIG. 5.

What is claimed is:

1. A method of building a permanent magnet assembly, comprising:

mechanically restraining a plurality of permanent magnet blocks so as to prevent the plurality of permanent magnet blocks from moving with respect to one another;

mechanically restraining a first permanent magnet block not in the plurality of permanent magnet blocks from moving in either a first direction relative to the plurality of permanent magnet blocks or in a second direction relative to the plurality of permanent magnet blocks, wherein mechanically restraining the first permanent magnet block from moving in the first direction comprises restraining the first permanent magnet block using a nonmagnetic frame, the first and second directions defining a plane, the first permanent magnet block having a first magnetic orientation;

moving the restrained first permanent magnet block with respect to the restrained plurality of permanent magnet blocks, the moving in a third direction not parallel to the plane, the moving to put the first permanent magnet block into a position proximate to the restrained plurality of permanent magnet blocks so as to form a desired angle between the first magnetic orientation and a magnetic orientation of one of the plurality of permanent magnet blocks;

further restraining the restrained first permanent magnet block in the position, including deforming the nonmagnetic frame.

2. The method of claim 1 wherein mechanically restraining the plurality of permanent magnet blocks comprises restraining at least some of the plurality of permanent magnet blocks using the nonmagnetic frame.

3. The method of claim 1 wherein the first magnetic orientation of the first permanent magnet block and the magnetic orientation of the one of the plurality of permanent magnet blocks differ.

4. The method of claim 3 wherein the desired angle between the first magnetic orientations of the first permanent magnet block and the magnetic orientation of the one of the plurality of permanent magnet blocks is 30 degrees.

* * * * *